US006561089B1

(12) United States Patent
Newman, Jr.

(10) Patent No.: US 6,561,089 B1
(45) Date of Patent: May 13, 2003

(54) SCREEN ASSEMBLY HAVING BORDER CONSTRUCTION WITH CUPPING FEATURES AND METHOD OF MAKING

(76) Inventor: Eugene F. Newman, Jr., 7946 Stonehurst Dr., Dublin, OH (US) 43016-9099

( * ) Notice: Subject to any disclaimer, the term of this patent is extended or adjusted under 35 U.S.C. 154(b) by 0 days.

(21) Appl. No.: 09/444,134

(22) Filed: Nov. 20, 1999

Related U.S. Application Data

(63) Continuation-in-part of application No. 09/398,867, filed on Sep. 20, 1999, now abandoned.

(51) Int. Cl.[7] ..... B41F 15/36; B41N 1/24

(52) U.S. Cl. ..... 101/127.1; 101/128.1; 101/128.4; 38/102.91

(58) Field of Search ..... 101/127, 127.1, 101/128.1, 128.21, 128.4, 129; 38/102, 102.1, 102.2, 102.3, 102.4, 102.91; 160/371, 372, 378, 380, 381

(56) References Cited

U.S. PATENT DOCUMENTS 1,561,534 A * 11/1925 Gray ..... 101/127.1
2,218,451 A * 10/1940 Heyne ..... 101/127.1
2,566,919 A * 9/1951 Black et al. ..... 101/415.1
3,214,314 A * 10/1965 Rowbottam ..... 101/127.1
3,273,497 A * 9/1966 Rosema et al. ..... 101/128.1
3,416,445 A * 12/1968 Krueger, Jr. ..... 101/127.1
3,991,677 A * 11/1976 Barnes ..... 101/127.1
4,134,340 A * 1/1979 Larson ..... 101/127.1
4,186,660 A * 2/1980 Key ..... 101/128.1
4,568,455 A * 2/1986 Huber et al. ..... 101/127.1
4,978,414 A * 12/1990 Ohtani et al. ..... 101/127.1
5,136,797 A * 8/1992 Hildebrandt ..... 101/127.1
5,274,934 A * 1/1994 Newman, Jr. ..... 101/128.1
5,379,691 A * 1/1995 Hamu et al. ..... 101/127.1
5,979,312 A * 11/1999 Williams ..... 101/127

* cited by examiner

*Primary Examiner*—Leslie J. Evanisko

(57) ABSTRACT

Improved methods and apparatuses for mounting screens on frames. Border strips with improved structural designs enable screens to be mounted so as to achieve higher tension more quickly and easily. Improved method permits screens to be mounted on frames with fewer steps. Also, improved bonding of border strips to screen fabric is taught.

13 Claims, 11 Drawing Sheets

SCREEN ASSEMBLY HAVING BORDER CONSTRUCTION WITH CUPPING FEATURES AND METHOD OF MAKING

CROSS REFERENCES TO RELATED APPLICATIONS

This Application is a Continuation-In-Part of patent application Ser. No. 09/398,867 which was filed on Sep. 20, 1999, now abandoned.

BACKGROUND OF THE INVENTION

1. Field of the Invention

The present invention relates to an improved method and apparatus for mounting screens on frames. More specifically, the present invention relates to improved shapes of border constructions comprising cupping features to engage frames and with improved methods of mounting screens on frames for screen printing.

2. Prior Art

The concept of putting border constructions, usually embodied as rigid or semi-rigid strips of narrow width, along the edges of screen fabric so as to better attach fabric to a frame was perhaps first described by M. Louis Courtial in French patent No. 909,651 of 1945. Although this patent addressed fabric used in furnishings, it could equally have been applied to screen fabric stretched on printing frames. Other notable innovations are described in U.S. Pat. No. 2,903,967 by H.S. Levin in 1959, U.S. Pat. No. 3,078,793 by D. Jaffa et al in 1963, U.S. Pat. No. 3,211,089 by Elmar Messerschmitt in 1965, U.S. Pat. Nos. 5,274,934 and 5,522,314 by this applicant, Eugene F. Newman, Jr., in 1994 and 1996, respectively, U.S. Pat. No. 5,379,691 by Alan and Kaino Hamu in 1995, U.S. Pat. No. 5,390,596 by Gregory Farr in 1995 and U.S. Pat. No. 5,443,003 by James Larson in 1995.

The border strips of the above inventions are described as having many shapes to engage many types of frames. Newman, Jr., Farr, and Larson describe border strips, sometimes referred to as retainers or constructions, which are shaped so as to hook or cup over edges of a frame. The Newman Jr. invention comprises means to fasten border strips to external stretchers to hook or cup the border strips in place on a rigid frame while tensioning the screen. The Newman, Jr. invention, however, suffers from the problem that without further instruction, it would seem that there is no way to mount fabric on a rigid frame to its maximum tension when the fabric is first stretched onto the frame without using spacers. Also, it would seem that it would not be possible to mount the screen at maximum tension with less than four spacers per screen. Screen printers often prefer high tension as it is generally thought that this contributes to a better print. Since the hooking or cupping of border strips over edges of a frame requires an outward movement followed by an inward movement, the final inward movement actually undoes or reduces the tension in the screen. In the initial outward movements to clear the edges of a frame, if a screen reaches maximum tension before tearing the fabric, the subsequent inward hooking movements would, of course, reduce screen tension below the maximum. By pulling the border strips outwardly, spacers could be inserted between the frame and the border strips within the cupping features of the border strips so as to expand and hold the screen on the frame at maximum tension. However, four spacers would be needed. The placement of only two spacers to achieve maximum tension, one for the width and one for the length of the frame, would cause the cupping features to extend outwardly beyond the edges of the frame. This would unhook the border strips. Therefore, four spacers, one for each edge of the frame, must be inserted to achieve maximum tension unless specific modifications are made to the border strips. The present invention teaches modifications to U.S. Pat. No. 5,274,934 for mounting screens at maximum tension without needing spacers. Furthermore, the present invention teaches that as the screen inevitably losses tension over time, the screen can be re-tensioned with only one spacer required per axis, or a total of two rather than four spacers per screen. The present invention is intended as an improvement to U.S. Pat. No. 5,274,934.

In U.S. Pat. No. 5,522,314, a method is taught for pre-stretching screen fabric on a stretcher device and attaching border strips to the stretched fabric in a pattern that bears a relationship to the shape and size of a frame. This method allows the fabric and border strips to be later re-stretched onto a prescribed frame of a certain shape and size so as to achieve a prescribed tension in the screen. This method is much faster than an earlier method as described in Farr in which fabric is stretched and attached to a frame, a very slow and labor-intensive process, before the border strips (retainers) are attached onto the fabric in a pattern. However, the Newman, Jr. invention suffers from the necessity of having to stretch the fabric twice, once in a pre-stretch to attach the border strips and again to mount the bordered screen onto the frame. If the border strips are already cupped or hooked onto edges of the frame when the border strips are attached to the stretched fabric, the need to later mount the bordered screen onto the frame is eliminated. What is missing in this earlier art is the concept of using actual screen frames as fixtures upon which to mount and position the border strips. The present invention seeks to achieve this objective.

Hamu et al describes a frame having border strips (anchors) that are inserted into channels embedded in the print-side of a frame. Hamu, like Farr, then stretches and attaches fabric to a second frame. The second frame is then placed onto the print-side of the first frame having the border strips and the stretched fabric is bonded to the border strips within the channels. In this way, the stretched fabric is transferred onto border strips already mounted in the frame. This invention suffers from the same slowness and labor-intensity of the Farr invention inasmuch as it requires that the fabric be first stretched and attached to a second frame.

On a rigid frame with no moving parts, the Hamu border strips are designed to only work in channels and must rely upon an outer wall in the channel. On such a frame there is no way to re-tension the screen and there is no way to dislodge the Hamu border strips without destroying the fabric. The Hamu invention continues on to describe a frame constructed with internal stretcher devices added to provide re-tensioning, but such a frame is very expensive to construct and the screen suffers from a continued inability to be removed from the frame without destroying the screen. The teachings of Hamu U.S. Pat. No. 5,379,691 and Newman, Jr. U.S. Pat. No. 5,522,314 can be combined, but the resulting combination would not advance the art so as the avoid the disadvantages of the Hamu frame. An objective of the present invention is to teach an improvement to the method of U.S. Pat. No. 5,522,314 that works with any simple rigid frame with edges that can be hooked or cupped over. This would be almost all existing rigid frames. The present method produces a screen that can be re-tensioned and can be removed from a frame having no moving parts without destroying the screen.

In 1997 this applicant began to make and sell screens having polypropylene border strips that are heat sealed onto the fabric. These border strips, however, differ substantially from the present invention and are inoperable with the frames of the present invention. These border strips have a unique shape as described in U.S. Pat. No. 5,957,048 by this applicant. They are designed to go inside a channel with the bonded fabric inserted into the channel on the bottom side of the border strips and wrapped around a leg portion of the border strip so as to become lodged and pressed against a wall on the inside of the channel. The bonding of the fabric is on the bottom side of the border strips facing away from the print-side of the screen and oriented upside down in relation to the printing surface of the screen. These border strips will only work in channels. Also, since the bonding surfaces of these border strips become hidden inside the channels when they are mounted on the frame, there is no way they can be bonded to the fabric when mounted on the frame. As will be seen, this is a difference that makes these screens unworkable in the present invention. Yet another consideration is that the bonding of the fabric to the border strips of U.S. Pat. No. 5,957,048 was not designed to be the primary locking mechanism of the fabric on a frame. This bonding only had to be sufficient to hold the fabric on the border strips until the fabric became wedged between a leg portion of the border strips and inside walls of the channels of the frame. This required very little strength of bond. Strength was not a concern. The strength of bond between the border strips and the screen fabric in the screens made and sold by this author prior to 1999 were insufficiently strong to be used in the present invention. The present invention needs exceptionally strong bonds between the border strips and fabric because this is the only mechanism that holds the screen onto the frame.

Until the present invention, it has been difficult to find suitable materials to use for border strips of printing screens. Metal border strips are expensive and can only be glued to the screen. Wood is unacceptable because it tends to swell up when wet and this too must be glued. Most plastics are also unacceptable because they are attacked by solvents in printing inks. Also, most plastics will not melt at an acceptable temperature to be heat sealed to screens. Polypropylene, high density polyethylene, and other thermal plastics not only have high resistance to solvents, do not swell up when wet, but they also are capable of being melted at relatively low temperatures that will not harm most screen fabrics. These thermal plastics are relatively inexpensive materials and they can be very cheaply mass produced by injection molding and extruding. The possibility of using these materials, however, has not been recognized in the art except, as mentioned earlier, the applicant began to experiment and develop border strips in 1997 and before. Applicant was for many years frustrated with developing the extremely strong bonds needed to singularly hold a tightly stretched screen on a frame. The problem was to further develop these bonds so the border strips of the present invention and other border strips would perform well under high tension.

Objectives of the present invention include teaching improvements in the structure of border strips, teaching a new method of mounting these border strips on frames, and teaching an improved bond through heat sealing thermoplastic border strips onto screens.

SUMMARY OF THE INVENTION

The present invention comprises a rigid frame having a prescribed shape and size with four sides and no moving parts. It further comprises a rectangular screen fabric having rigid or semi-rigid border strips adhered to precisely measured locations along a portion of each edge of the screen fabric, not in the corner areas. The screen fabric and border strips are of a size and shape that bear a relationship with the size and shape of the frame. The screen fabric and border strips can be stretched onto the frame so as to achieve a prescribed tension in the screen, such as the recommended maximum safe tension for the fabric material before it tears. The border strips are hook-shaped or cupped so as to hook or cup onto the edges of a frame, holding the screen on the frame. The border strips can be pulled into place by hand or by external stretcher devices or in certain cases, as will be seen, the border strips may comprise internal stretcher devices. The elongated hook-like structures or cupping flanges of the border strips of the present invention may be of equal width on all border strips. However, in the preferred embodiment, two adjacent border strips comprise relatively wide cupping flanges and these are manually mounted first on the frame. The opposite adjacent border strips comprise cupping flanges of relatively narrow width, or in the alternative, as will be seen, these border strips may comprise removable sleeves which function much the same as flanges and which can slide off and on the border strips. Furthermore, the border strips may hook onto border connectors that, likewise, hook over the edges of a frame. Numerous embodiments of the present invention are possible.

In one embodiment of the present invention, border strips comprising adjacent relatively wide cupping flanges are manually mounted first and are opposite to border strips comprising relatively narrow cupping flanges. The border strips with relatively narrow cupping flanges can be pulled onto the frame by hand or by external stretchers, depending upon the degree of tightness sought. Because of the outward movement followed by an inward movement of the last two border strips, the screen ends up with less than maximum tension due to the final inward movement. The narrowness of the cupping flanges does minimize the loss of tension, however, assuming that it is intended that the screen be tightly stretched during the initial stretching. Because the cupping flanges on two adjacent border strips are relatively wide, spacers can easily be inserted into the gaps formed when these border strips are pulled away from the frame by an external stretcher device. The width of the relatively narrow cupping flanges is a distance the fabric relaxes when these border strips are first hooked or cupped and it is the minimum distance required to re-tension to reach maximum screen tension. If the widths of the cupping flanges of opposite border strips were the same, this would unhook either border strip, assuming that only one border strip is pulled outwardly. However, if the widths of the cupping flanges of the opposite border strips were unequal, the difference in their widths is the incremental distance beyond the minimum distance required to reach maximum screen tension before the relatively wide cupping flange becomes unhooked. This extra distance facilitates re-tensioning and permits one and not necessarily two of a pair of opposite border strips to be outwardly spaced on a frame so as to re-tension the screen up to maximum tension. Since there are two pairs of opposite border strips on a screen, this means two and not four border strips would need to be so spaced, a considerable savings in time and effort. If the border strips are on a relatively large piece of fabric in relation to the size of the frame, the difference in the widths of the cupping flanges must correspondingly be that much larger. Similarly, if the border strips are on a small piece of fabric in relation to the size of the frame, the difference in the widths of the cupping flanges can be correspondingly less. The size of the piece of fabric is determined by how much the fabric is stretched and the distance between border strips when the border strips are bonded to the fabric. A screen with a large difference in the widths of the cupping flanges would allow the screen to be stretched a large distance after mounting on a frame. If the screen were designed to tightly mount on the frame initially, less of an incremental stretch would be needed to bring the screen up to the maximum tension before tearing would occur.

All the border strips of the present invention may also comprise internal devices such as screws that could move these border strips to more outward positions from the frame edges. These could re-tension the screen without an external stretcher device.

In the above embodiment, the screen may have closely approached maximum tension in the initial stretching process, but it could not be mounted on the frame at maximum tension because of the final inward movement which undoes some of the tension. In an alternative embodiment, sleeves or caps that slide off and on the border strips along a tongue and groove joint serve as the cupping flanges. During the stretching process, the cap-sleeves are slid off the border strips. Stretcher devices pull all four border strips outwardly until the flat inside walls of the border strips align with the flat outside edges of the frame. At this point, the frame is inserted between all the border strips, the frame edges abut against the inside walls of the base of the border strips. The cap-sleeves are then put back on to the border strips. The cap-sleeves function like cupping flanges and hold the screen on the frame. Since there is no backward movement of the screen, it can be initially stretched all the way to maximum tension for mounting on the frame.

Although it would seem that the cap-sleeves need not have unequal cupping widths, the present invention comprises border strips with cap-sleeves having equal or unequal cupping widths. As will be later seen, such may be desirable to offer flexibility in how the screen is stretched on the frame initially and then later re-tensioned. Also, border strips having cap-sleeves may further comprise internal stretcher devices such as screws.

On larger frames, it may be necessary to have quite large border strips. If the strips are made of a disposable material, such as plastic, in which the material is permanently sealed onto the screen, disposing of the strips with every screen would be very wasteful. This is due to the amount of material involved. In order to reduce waste, it may be desirable to use border connectors that can hook or cup onto the large frame and which comprise edges over which relatively small border strips of disposable material can hook. The border connectors can be used over and over. These reusable border connectors can be shaped just like the various border strips described earlier. They may have permanent cupping flanges or they may have slide off and on cap-sleeves. They may have cupping flanges of equal or unequal widths as described above. The relatively small and inexpensive disposable border strips permanently attached to a screen hook onto the relatively large reusable border connectors which are hooked over the edges of the large printing frame. Since only the narrow lightweight strips are disposed of, there is much less waste than would otherwise be the case.

The border connectors described above may comprise means to attach to external stretcher devices or comprise internal stretching devices such as screws so as to retension the screen. Also, the border strips themselves, of course, as described earlier may comprise these features.

The present invention comprises border strips described above already adhered to fabric in precisely measured locations along each edge of the screen fabric, not in the corner areas. The present invention also comprises border strips as described above that are not adhered to fabric. The unattached border strips may be hooked or cupped over edges of frames so as to be mounted on the frames. Similarly, the unattached border strips may be hooked or cupped over the edges of connectors that are hooked or cupped over the edges of frames so as to mount the border strips and connectors on the frames. While so mounted, a single frame or a plurality of frames may have a sheet of fabric stretched by an external stretcher device with the fabric touching the top surfaces of the border strips. The fabric need not be stretched and mounted to an oversized frame but merely stretched with a stretcher device such as pneumatic clamps. With the fabric so stretched to a prescribed tension, the fabric is bonded to the frame mounted border strips. This completed, the external stretcher device can reduce the force exerted and the fabric held in place between the border strips on the frames will remain under high tension on the frames. Fabric outside the frame dimensions, which now is not tightly stretched, can be trimmed away and the frame or frames are ready for use. The above method saves time in mounting the bordered screens because the fabric is stretched only once, not twice, and the fabric is never mounted first on one frame and then on another frame. The above method can be used with all embodiments of the present invention. It can, likewise, be used with any existing frame that has edges suitable for hooking or cupping border strips and/or connectors. This would be almost any type of screen frame. The above method results in screens that are not permanently adhered to a frame and can be removed from the frame without destroying the screen. The screens can be re-tensioned. The frames do not have messy glue all over them when the screens are removed, so there is no clean up.

In the present invention, glue may be used to bond the fabric and border strips together. It is preferred, however, that the border strips be made of polypropylene or a similar material that can be heat sealed to the fabric. Polypropylene has a melting point much lower than most screen fabrics such as polyester. Experimentation has shown that polypropylene, if melted at 335 degrees Fahrenheit, will bond to polyester screen fabrics without harming the polyester screen. Border strips can be heat sealed to stretched fabric using an overhead plate that is powered so as to descend and ascend and comprises heat pads arranged to align and forcefully press onto screen fabric sandwiched between the heat pads and border strips. The border strips are mounted onto the edges of a frame or connectors on a frame. The border strips may also be mounted on a fixture under the stretched fabric in a pattern that bears a relationship to the size and shape of a prescribed frame. This process will produce bonds that are only minimally strong, however, because the polypropylene subtly sticks to the heat pads as they ascend, slightly pulling apart the fabric and polypropylene so as to leave a weakened bond. In the present invention, in order to achieve strong bonds, vellum paper or the like is sandwiched between the heat pads and the fabric. A stick resistant coating on the heat pads is also helpful. These steps taken, the subtle sticking is eliminated and the heating process produces surprisingly strong and consistent bonds.

A simple ironing device similar to those used to iron clothes can also heat seal the polypropylene border strips and fabric together. The heated iron is placed over the stretched fabric in contact with border strips that are mounted onto the edges of a frame or connectors on a frame. The border strips may also be mounted on a fixture under the stretched fabric in a pattern that bears a relationship to the size and shape of a prescribed frame. With the fabric sandwiched between the iron and the border strips, hand pressure is applied downwardly on the iron. In only a few seconds the polypropylene will melt adequately to bond to the fabric. By moving the iron along the paths of the border strips, the border strips and fabric are sealed together. If the iron has a very smooth bottom surface with a non-stick coating and/or if vellum paper is sandwiched between the iron and the fabric, sticking of the polypropylene to the iron is eliminated and again surprisingly strong seals are obtained. This process eliminates the fumes that are associated with gluing, it is fast, and it forms very strong bonds.

DETAILED DESCRIPTION

Figure 1:
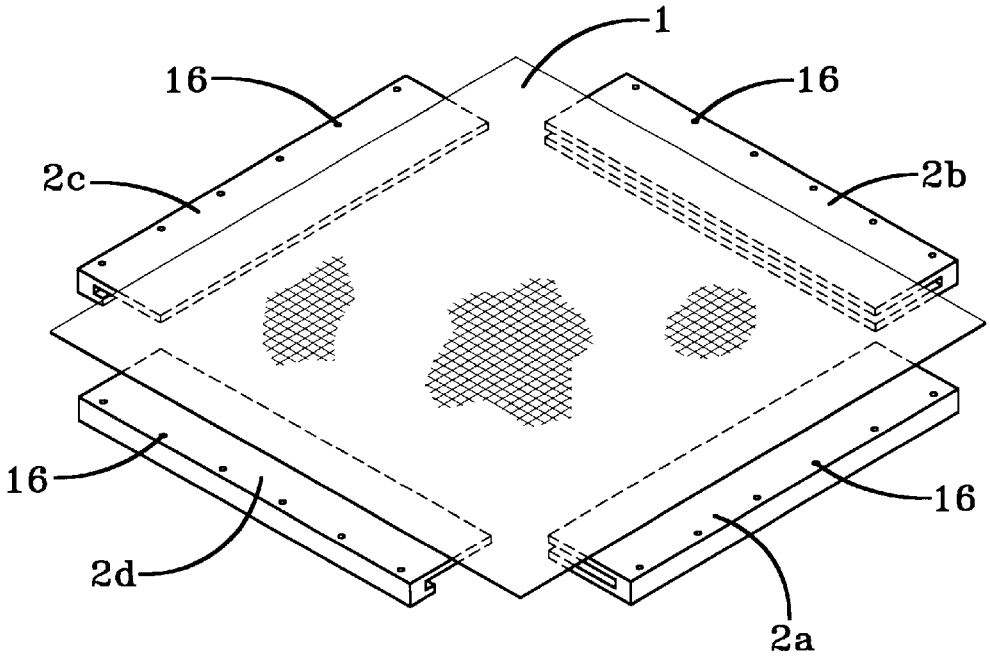
FIG. 1 is a perspective drawing of one embodiment of the bordered screen of the present invention as seen from the bottom or print side.

The present invention comprises a screen 1 that has been stretched to a prescribed tension during which border strips 2*a*, 2*b*, 2*c*, and 2*d* have been attached to said screen 1 in a prescribed pattern that has a relationship to a frame 3 of a prescribed size and shape. Each border strip has a print-side flange 4 to which the screen 1 is attached by some bonding means such as gluing or heat sealing. Border strips 2*a* and 2*b*, which are adjacent to each other, each comprise a cupping flange 5 that is relatively wide compared to a cupping flange 6 of border strips 2*c* and 2*d*. Print-side flanges 4 and cupping flanges 5 of border strips 2*a* and 2*b* are parallel to each other and are joined to a border strip base 7. Print-side flanges 4 and cupping flanges 6 of border strips 2*c* and 2*d* are also parallel to each other and are also joined to a border strip base 7. The space bounded by the inside wall 8 of flange 4, the inside wall 9 of flanges 5 and 6, and the inside wall 10 of base 7 forms a pocket 12 which has a height substantially the same as the thickness of frame 3. Border strips 2*a*, 2*b*, 2*c*, and 2*d* are designed to cup and slide onto the sides of frame 3. Print-side flange 4 is designed to fit flush against the print side surface 11 of frame 3 with cupping flanges 5 of border strips 2*a* and 2*b* and cupping flanges 6 of border strips 2*c* and 2*d* fitting flush against the opposite side 40 of frame 3. Sides 13*a*, 13*b*, 13*c*, and 13*d* of frame 3 are able to snugly fit into the pockets 12 of border strips 2*a*, 2*b*, 2*c*, and 2*d*, respectively, and abut against wall 10 with print side flange 4 of each border strip overlapping the print side surface 11 of frame 3 and the cupping flanges similarly overlapping the opposite side 40 of the frame. The difference in depth between the relatively deep pockets 12 of border strips 2*a* and 2*b* and the relatively shallow pockets 12 of border strips 2*c* and 2*d* represents the extra distance that screen 1 can be stretched if border strips 2*a* and 2*b* rather than 2*c* and 2*d* are spaced outwardly on frame 3. If this difference is substantial enough, only two spacers per screen rather than four spacers are all that are needed to fully re-tension the screen. How tightly bordered screen 1 is designed to initially mount on frame 3 is a function of how much fabric material is bounded by border strips 2*a*, 2*b*, 2*c*, and 2*d*. If screen 1 has a relatively small amount of fabric material in relation to the size of the frame, it will very tightly mount onto frame 3. The incremental stretching needed to bring screen 1 to maximum tension may be less than the difference in widths between the cupping features of the opposite border strips if said relative widths and said screen size bear a relationship that produces that result. A relatively tight fitting screen and relatively disparate border strips width will easily allow the screen to attain a maximum tension by inserting only one spacer per pair of opposite border strips.

Figure 7:
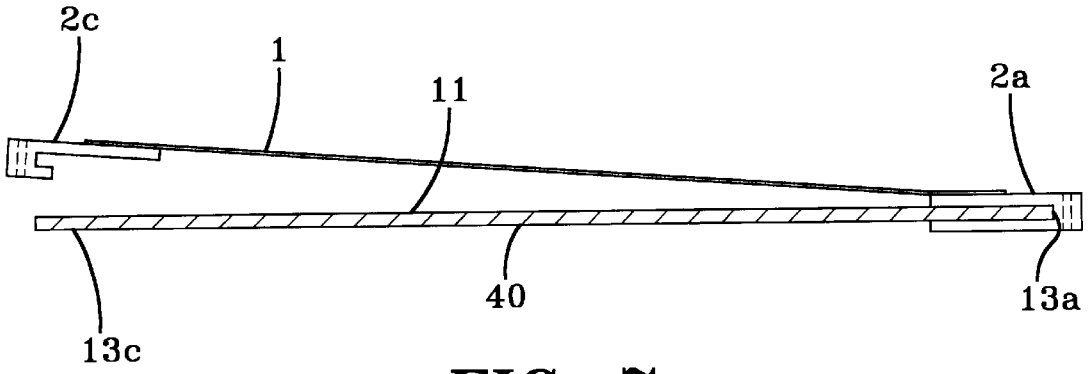
FIG. 7 is a side view of the rigid frame of the present invention with a border strip having a relatively wide cupping flange mounted onto one side of the frame while the opposite border strip having a relatively narrow cupping flange is not yet mounted on the frame.
Figure 8:
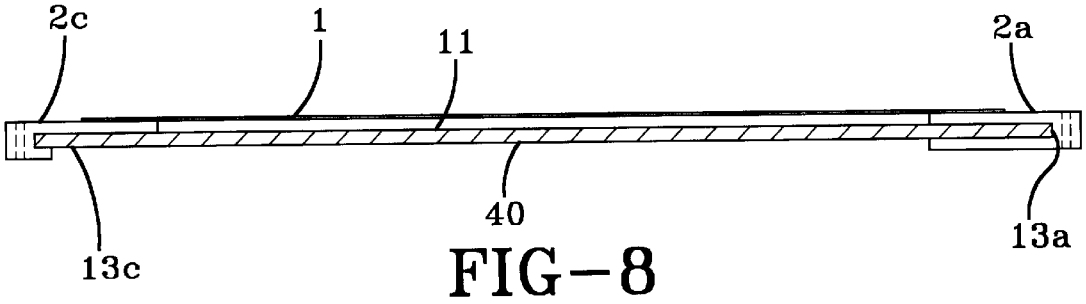
FIG. 8 is a side view of a rigid frame of the present invention with a border strip having a relatively wide cupping flange mounted onto one side of the frame and the opposite border strip having a relatively narrow cupping flange also mounted on the frame.

The first step in stretching the screen of the present invention is to mount border strip 2*a* onto designated side 13*a* of frame 3. This is done by cupping border strip 2*a* over the side of the frame and deeply sliding the border strip onto the frame so as to abut wall 10 against the outside edge of side 13*a* of the frame as shown in FIG. 7. Next, border strips 2*c* and 2*b* are mounted in a similar way to sides 13*c* and 13*b*, respectively. These two border strips may be mounted in either order of succession. FIG. 8 shows opposite border strips 2*a* and 2*c* mounted on the frame. Border strip 2*d* is the final border strip mounted. If frame 3 is not a square, it is essential that the border strips are mounted on the frame in a pattern that matches the pattern of the frame. The relationship of the pattern of the dimensions of the bordered screen to the pattern of the dimensions of the frame must be matched together in the mounting process. It is also essential that the first border strip mounted on the frame must comprise a relatively wide cupping flange and the last border strip mounted must comprise a relatively narrow cupping flange. Therefore, either 2*a* or 2*b* must be first mounted and either 2*c* or 2*d* must be last mounted. In the preferred embodiment, the initial mounting of the bordered screen on the frame results in a loosely mounted screen. This is possible when the bordered screen is designed to achieve this result and is advantageous because the screen can be initially mounted by hand without the need of a mechanical external stretcher device. The amount of fabric between the border strips determines how loosely or how tightly the screen fits on the frame when it is initially mounted. If the fabric is stretched when the border strips are adhered to the fabric, the amounting of stretching and the distance between the border strips when they are adhered determines the amount of fabric on the screen. A very tightly stretched piece of fabric with the border strips adhered relatively close together in relation to the size of a prescribed frame results in a bordered screen that will later go onto the prescribed frame rather tightly when it is mounted. The opposite is true if the fabric is stretched less and if the border strips are adhered to the fabric relatively far apart in relation to the size of the prescribed frame.

Figure 3:
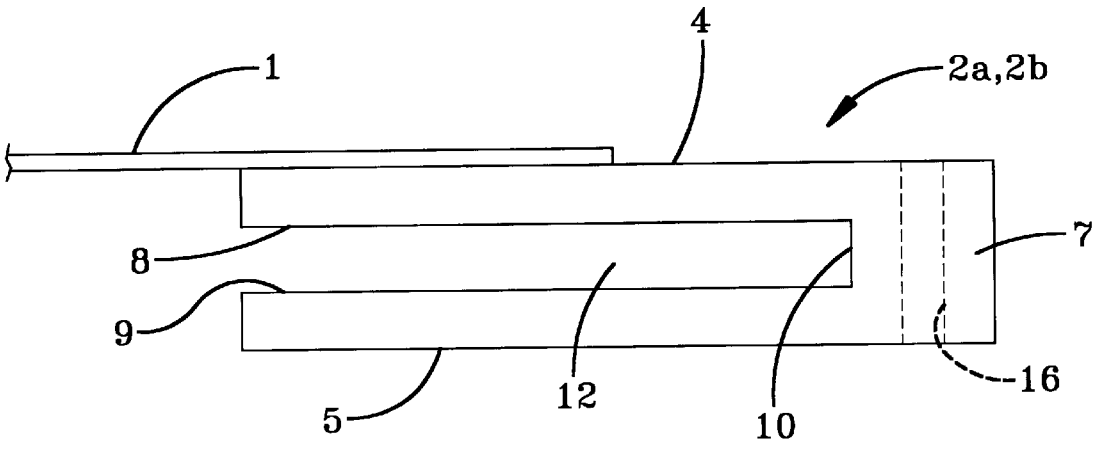
FIG. 3 is a side view of a border strip in a print-side-up position having a relatively wide cupping flange.
Figure 4:
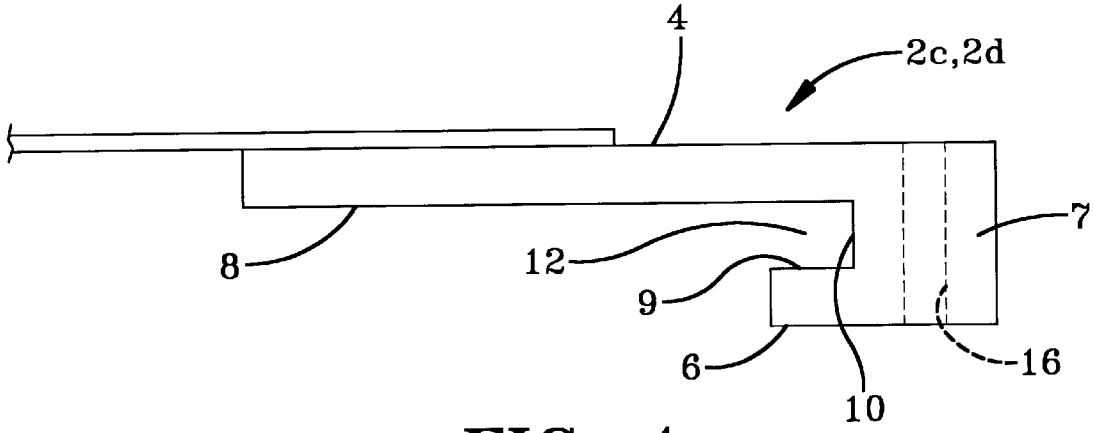
FIG. 4 is a side view of a border strip in a print-side-up position having a relatively narrow cupping flange.
Figure 5:
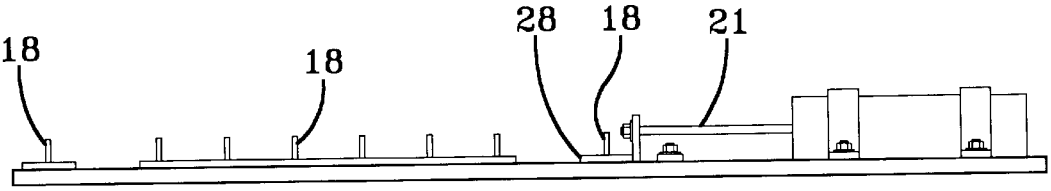
FIG. 5 is a side view of a frame holding fixture and a stretcher device.
Figure 6:
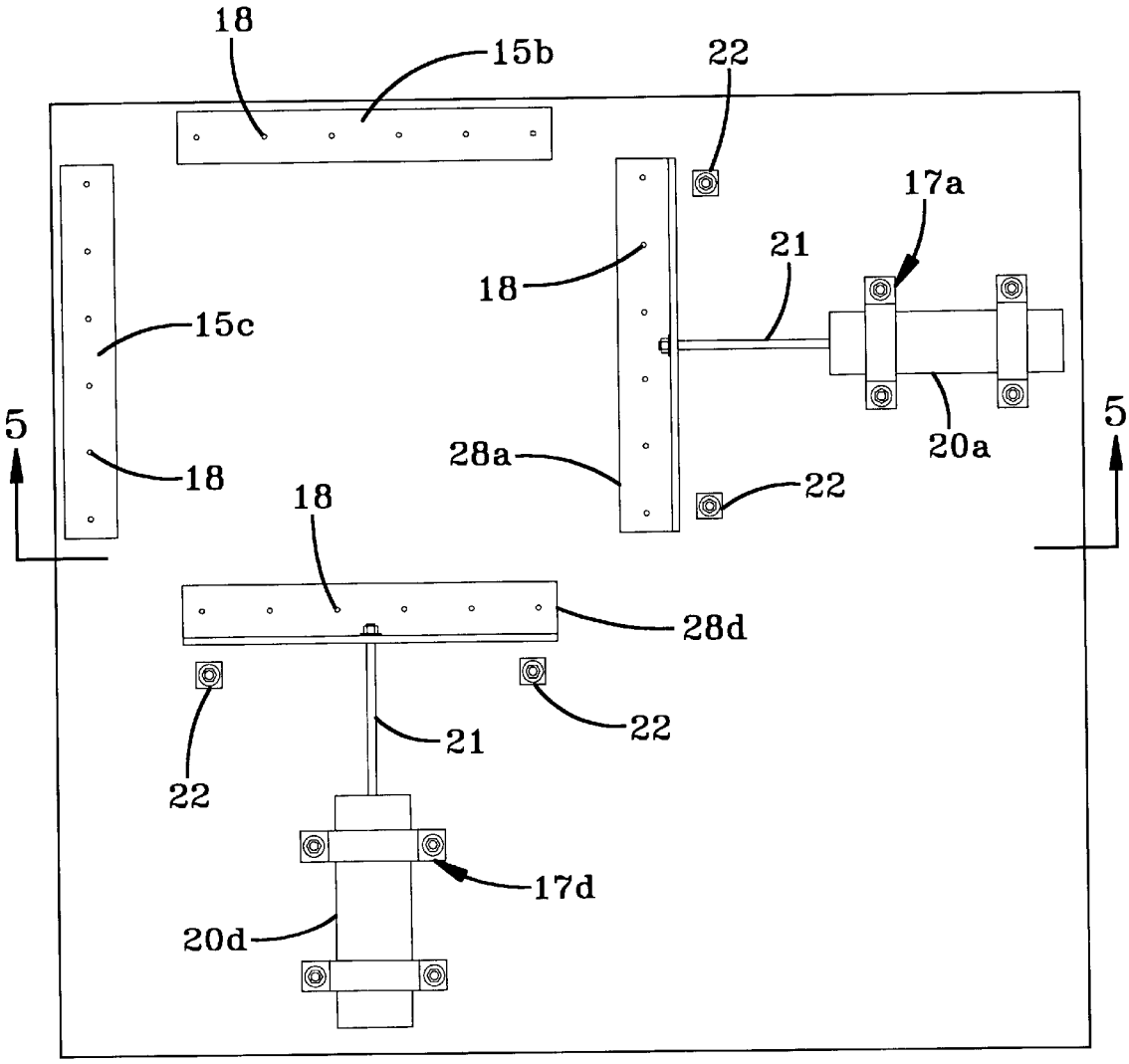
FIG. 6 is a top view of a frame holding fixture and stretcher devices.
Figure 9:
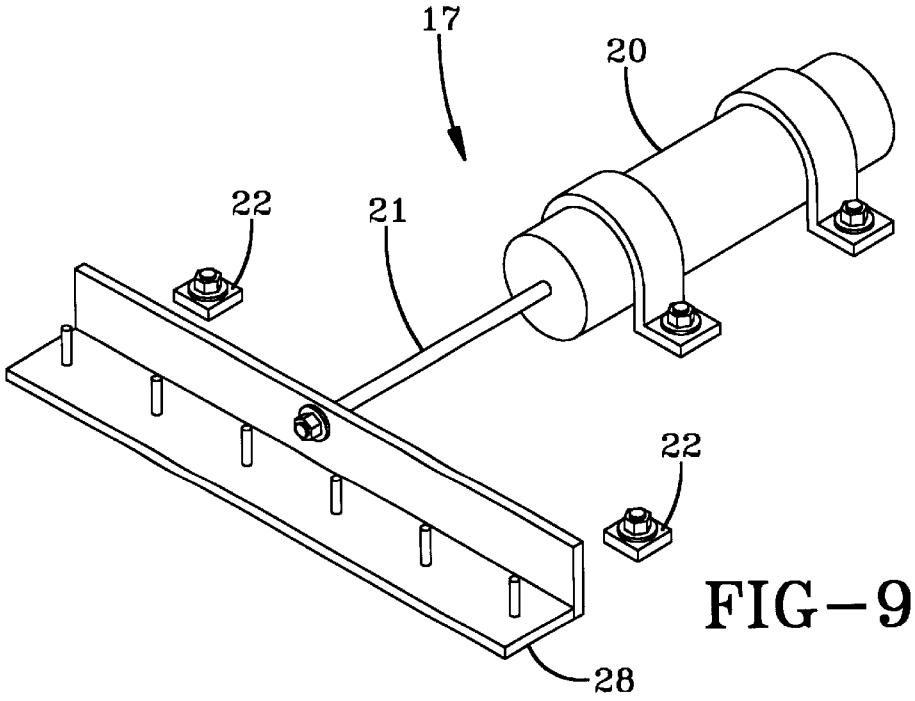
FIG. 9 is a perspective drawing of a stretcher device.
Figure 10:
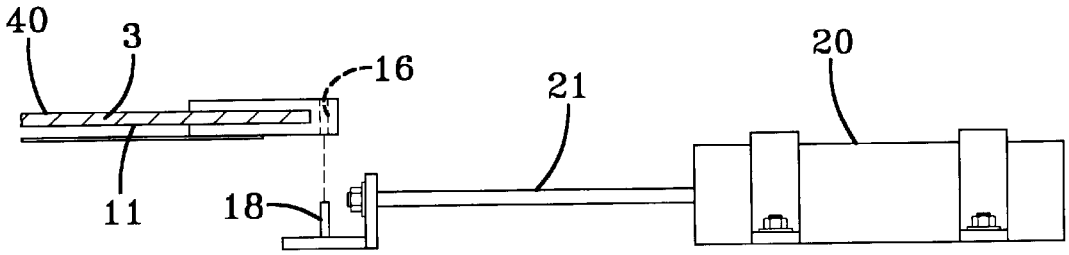
FIG. 10 is a side view of a frame and bordered screen in a print-side-down position and a stretcher device with the attaching elements of the stretcher not completely attached to a border strip of the bordered screen.
Figure 11:
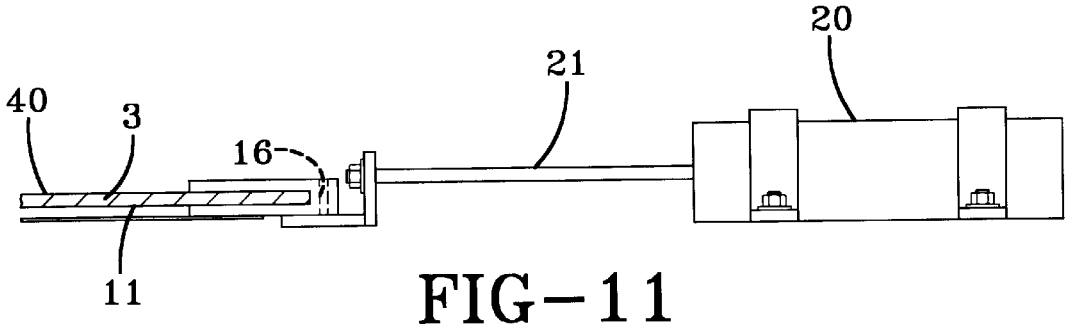
FIG. 11 is a side view of a frame, bordered screen, and stretcher device with the attaching elements of the stretcher attached completely to a border strip of the bordered screen.
Figure 12:
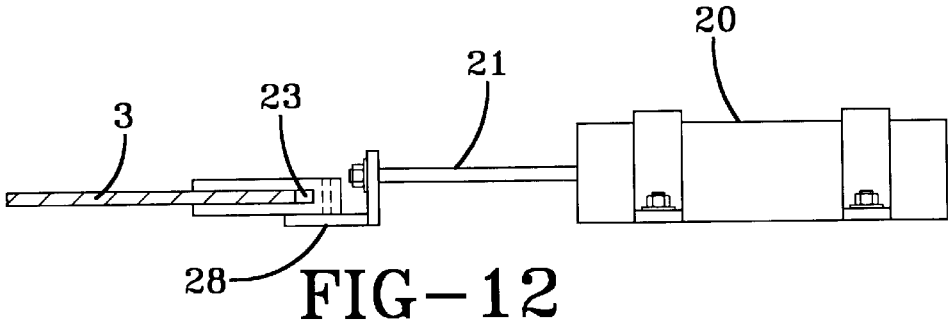
FIG. 12 is a side view of a frame and bordered screen in a print-side-down position and a stretcher device with the attaching elements of the stretcher attached completely to a border strip of the bordered screen and the border strip pulled outwardly from the frame a prescribed distance.
Figure 13:
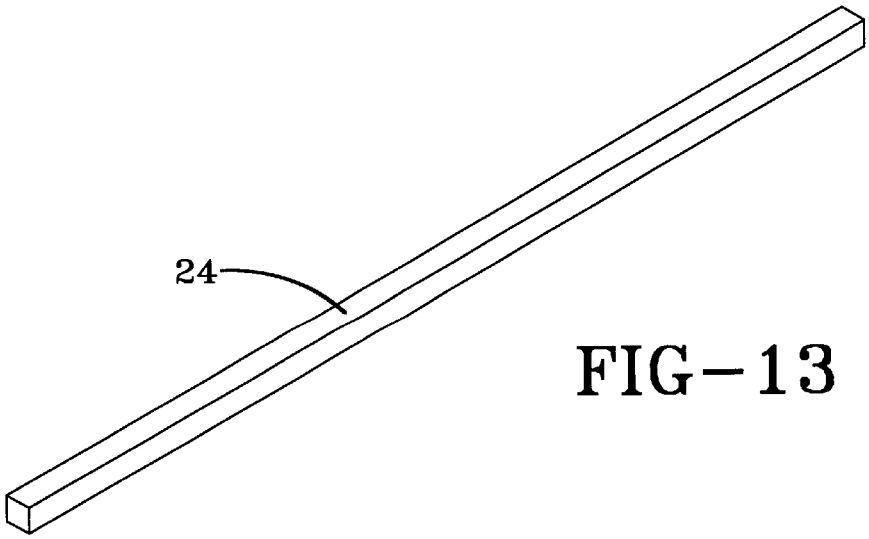
FIG. 13 is a perspective drawing of a spacer pin.

To incrementally stretch screen 1 very tightly, it is necessary to employ an external stretcher device 17, shown in FIG. 9, capable of pulling the screen sides outwardly. FIG. 9 shows an air cylinder 20 suitable for this purpose. The pulling shaft 21 of the device is connected to a moveable platform 28. This platform at the fullest extension of shaft 21 can be positioned so as to align precisely opposite a stationary platform. FIGS. 5 and 6 show stationary platforms 15*b* and 15*c* positioned opposite moveable platforms 28*a* and 28*d*. Stationary platforms 15*b* and 15*c* are anchored to a base surface and air cylinders 20*a* and 20*d* are also anchored to this base surface. Platforms 28*a*, 15*b*, 15*c*, and 28*d* comprise teeth 18. These teeth are of a size, shape, and arrangement so as to match the size, shape, and arrangement of holes 16 of border strips 2*a*, 2*b*, 2*c*, and 2*d*, as shown in FIGS. 1, 3, and 4. The stationary platforms 15*b* and 15*c* and the moveable platforms 28*a* and 28*d* in their fullest extension on shafts 21 are arranged in a pattern wherein teeth 18 are arranged in a pattern that matches the arrangement of holes 16 on border strips 2*a*, 2*b*, 2*c*, and 2*d* when these border strips are mounted on the sides 13*a*, 13*b*, 13*c*, and 13*d* of frame 3. By simply aligning holes 16 with teeth 18 and inserting the teeth into the holes, as shown in FIGS. 10 and 11, the bordered screen and frame of FIG. 8 can be mounted on stretching device 17. With the teeth 18 so inserted into holes 16, by pulling the moveable platforms 28*a* and 28*d* outwardly a prescribed distance to stoppers 22, a gap 23, shown in FIG. 12, of a prescribed width is made in pockets 12 of border strips 2*a* and 2*d*. Within this gap can be inserted spacer 24 of the same width as gap 23 by gently tapping it in with a hammer. Once spacers 24 have been inserted, the re-tensioned frame, which may now be at maximum tension, can be pulled off the stretcher device ready for use.

The border strips of the present invention also comprises cupping flanges that are of equal width. As will be shown, these border strips in combination with other embodiments of the present invention produce useful results.

Figure 14:
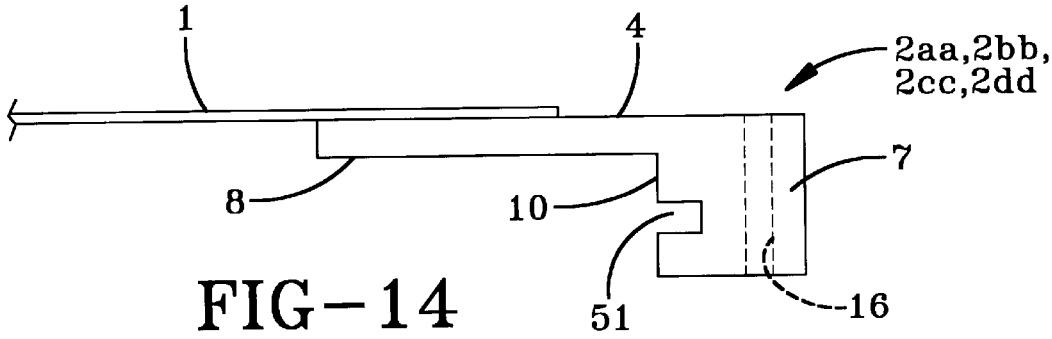
FIG. 14 is a side view of a modified border strip in a print-side-up position having a groove for engaging a cap-sleeve.
Figure 15:
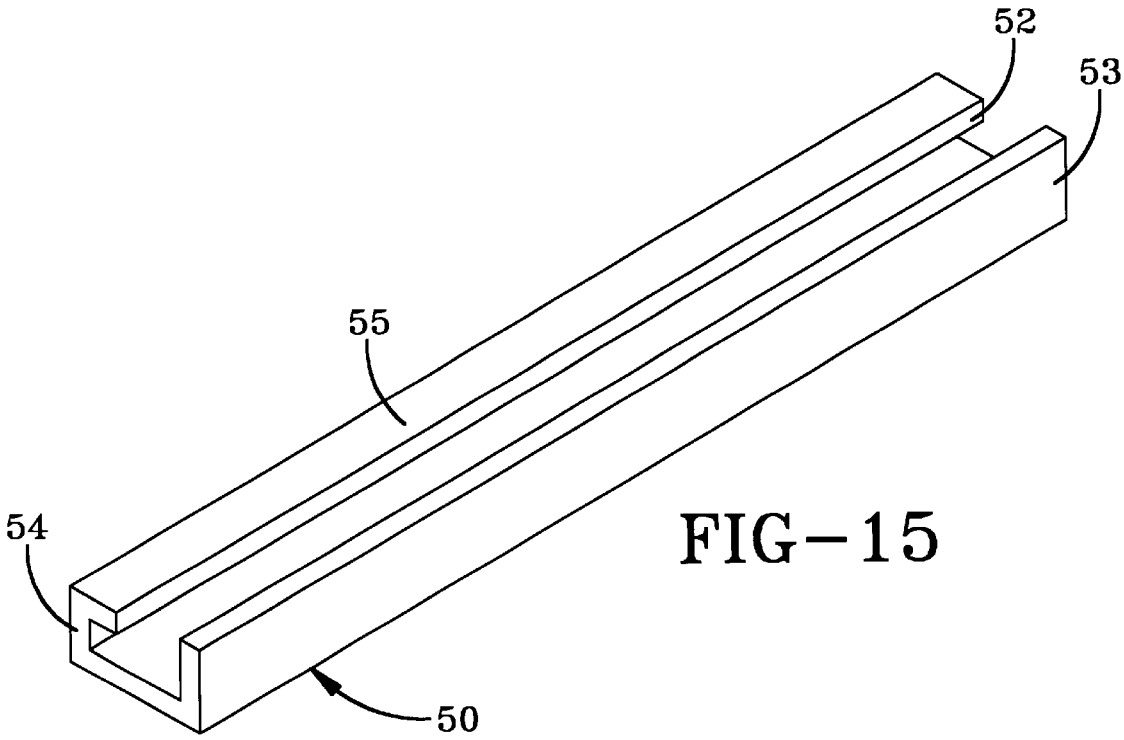
FIG. 15 is a perspective drawing of a cap-sleeve.
Figure 16:
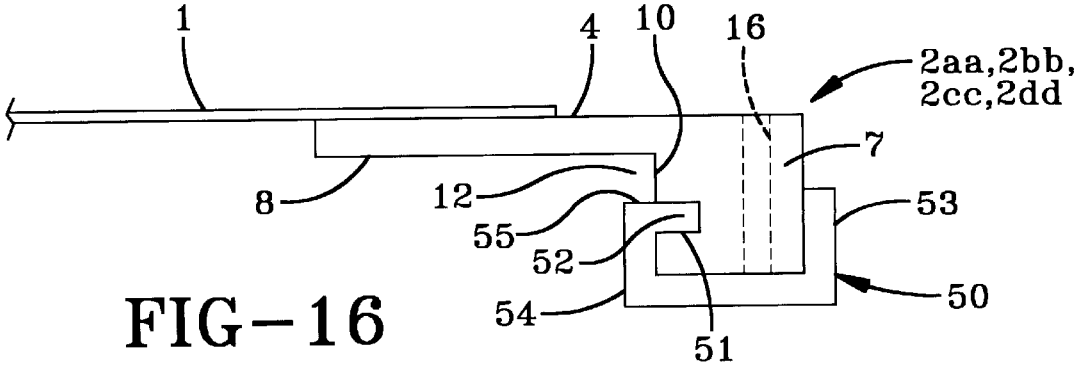
FIG. 16 is a side view of a modified border strip in a print-side-up position with a cap-sleeve joined to the strip.
Figure 17:
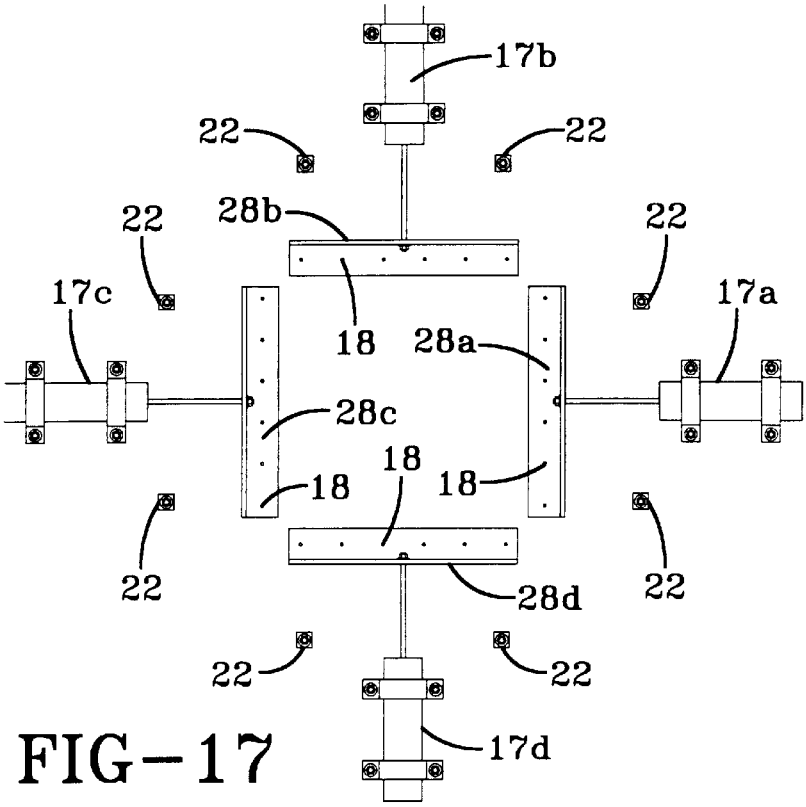
FIG. 17 is a top view of a stretcher device having four moveable platforms positioned in their most inward positions.
Figure 18:
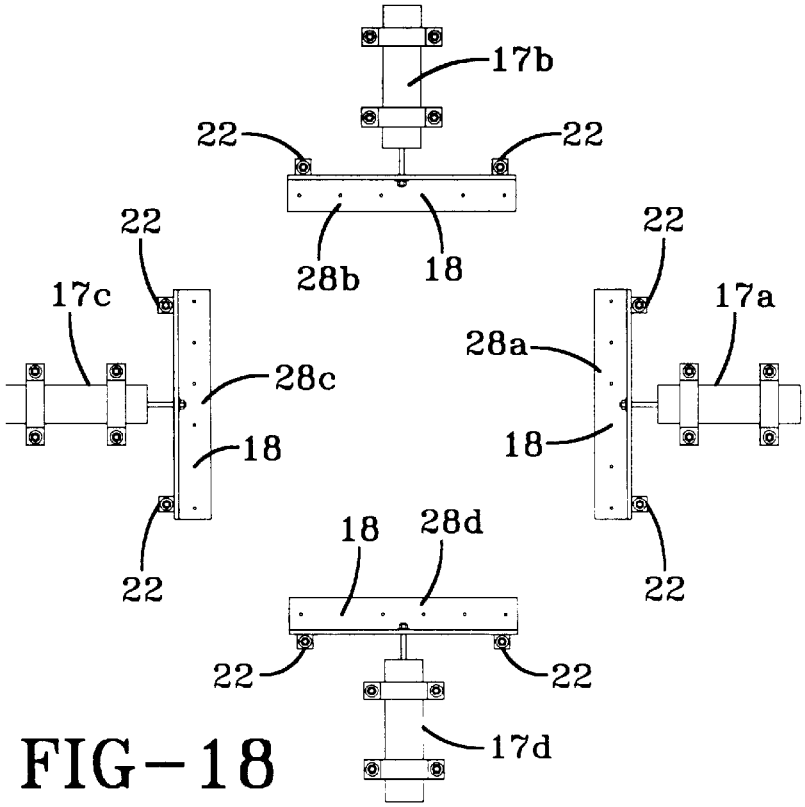
FIG. 18 is a top view of a stretcher device having four moveable platforms positioned in outward positions.
Figure 19:
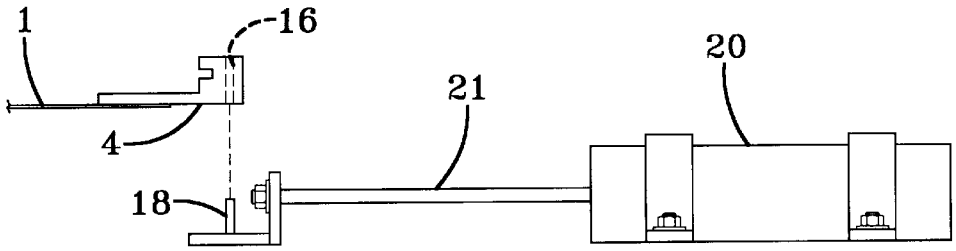
FIG. 19 is a side view of a stretcher device with a modified border strip being mounted onto the stretcher device in a print-side-down position.

A second embodiment of the present invention involves a modification of the border strips and the method of stretching the screen. FIG. 14 shows the new border strips. The cupping flanges 5 and 6 have been taken out of the design. Just below the inside wall 10 of base 7 is an elongated groove 51 running the length of the border strips. The base 7 may be deeper and wider than before so as to provide room for groove 51. Four stretchers, as shown in FIGS. 17 and 18 are arranged in a pattern so as to have teeth 18 forming along the lines of a rectangle in relation with the holes 16 on border strips 2*aa*, 2*bb*, 2*cc*, and 2*dd* mounted on the sides of frame 3. Stoppers 22 are pre-arranged to ensure that moveable platforms 28*a*, 28*b*, 28*c*, and 28*d* stop to align teeth 18 in this pattern. The air cylinders of stretchers 17*a*, 17*b*, 17*c*, and 17*d* then move the moveable platforms 28*a*, 28*b*, 28*c*, and 28*d* to positions well inward from the stoppers so as to allow the screen to be mounted on the stretchers. Since the teeth 18 have been moved substantially inward, it is now possible to mount the border strips on the teeth 18 through holes 16 on the border strips with the screen fabric 1 relaxed and not on frame 3. The screen is not yet mounted on the frame. The border strips are put on print-side first with print-side flange 4 facing downward, shown in FIG. 19. Next, stretcher devices 17*a*, 17*b*, 17*c*, and 17*d* pull the platforms 28*a*, 28*b*, 28*c*, and 28*d* outwardly until they are stopped by stoppers 22. The inside walls 10 of the border strips, at this time, are aligned with the outside edges of the sides 13*a*, 13*b*, 13*c*, and 13*d* of frame 3 and the frame can slip down snuggly between the border strips. At this point cap-sleeves 50, as shown in FIG. 15, are slid onto border strips 2*aa*, 2*bb*, 2*cc*, and 2*dd* by inserting tongue 52 of the cap-sleeves 50 into groove 51 if the border strips. As seen in FIG. 16, flanges 53 and 54 help to hold the cap-sleeve 50 on the border strips by abutting the base 7 of the border strips. The sliding of the cap-sleeves onto each of the border strips locks the screen on the frame. Surface 55 of the cap-sleeve 50 acts as a cupping flange to hold the border strips onto frame 3. With all four border strips locked on in this manner, the screen can be pulled off the stretcher devices 17 and it is ready for use. It should be noted that the teeth 18 must not be taller than base 7 of the border strips so as not to interfere with the cap-sleeves. The screen can be designed so as to attain maximum tension in the initial stretching of the screen of this embodiment of the present invention because there is no backward movement of the screen during the stretching process. Also, depending on the width of surface 55 of the cap-sleeve 50, this screen can be re-tensioned as the screen loses tension over time. The stoppers 22 of stretch devices 17 must be moved outwardly by an amount equal to the desired gap 23. Otherwise, the re-tensioning of this embodiment of the present invention is the same as earlier described embodiments.

The cap-sleeves of the present invention may be of equal width or they may be of unequal width. Adjacent cap-sleeves of wider width than opposite cap-sleeves additionally permit the bordered screen to be mounted on a frame as described earlier for border strips of unequal cupping flange widths. The cap-sleeves are simply slid onto the border strips before mounting the bordered screen on a frame.

Figure 2:
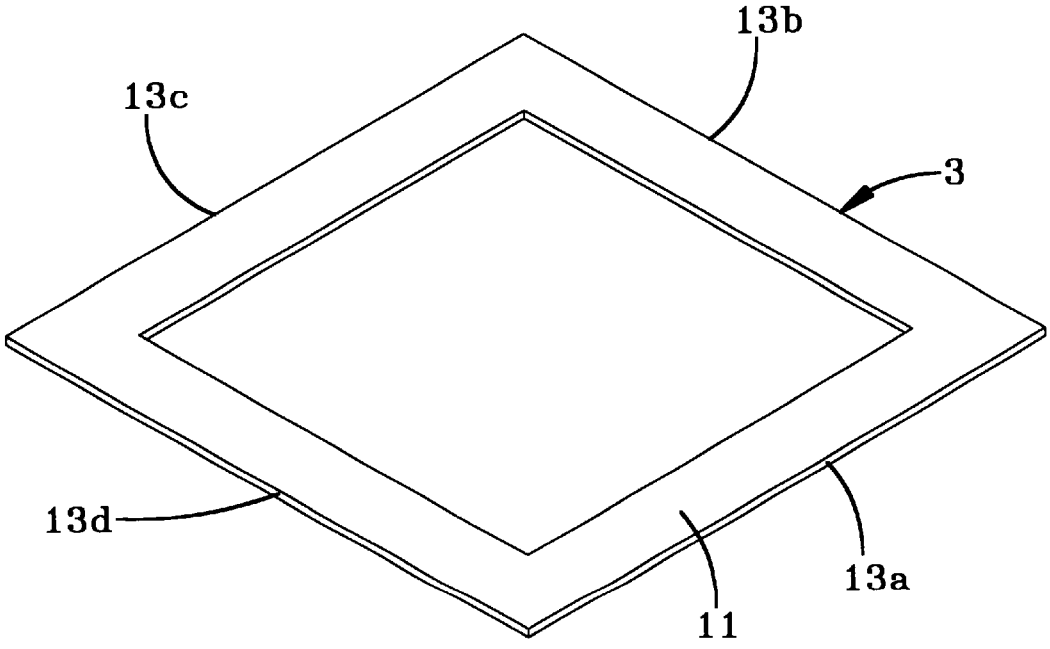
FIG. 2 is a perspective drawing of one embodiment of the rigid frame of the present invention as seen from the bottom or print side.
Figure 20:
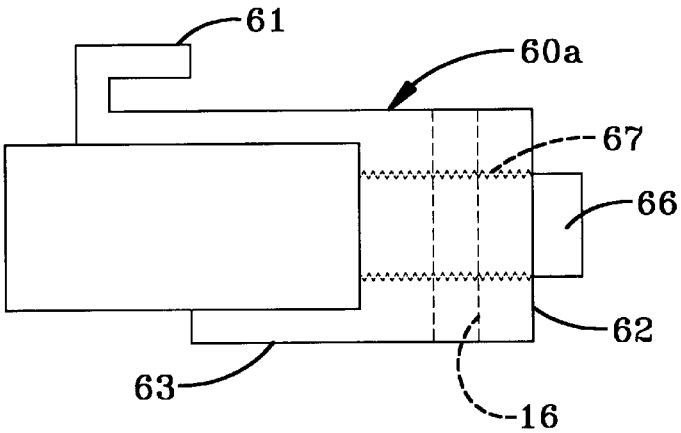
FIG. 20 is a side view of a connector having a relatively wide cupping flange mounted on a frame.
Figure 21:
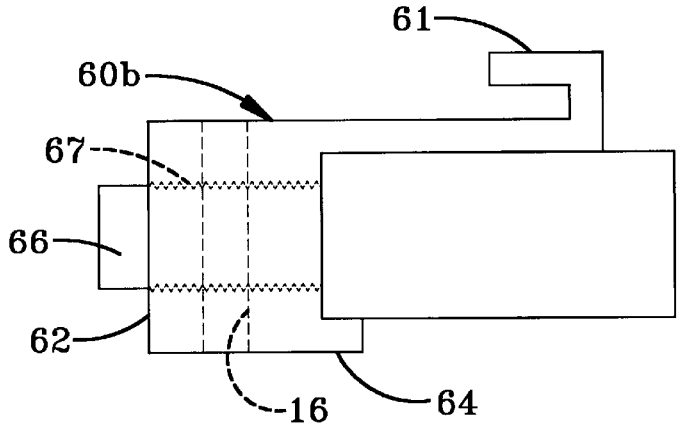
FIG. 21 is a side view of a connector having a relatively narrow cupping flange mounted on a frame.
Figure 22:
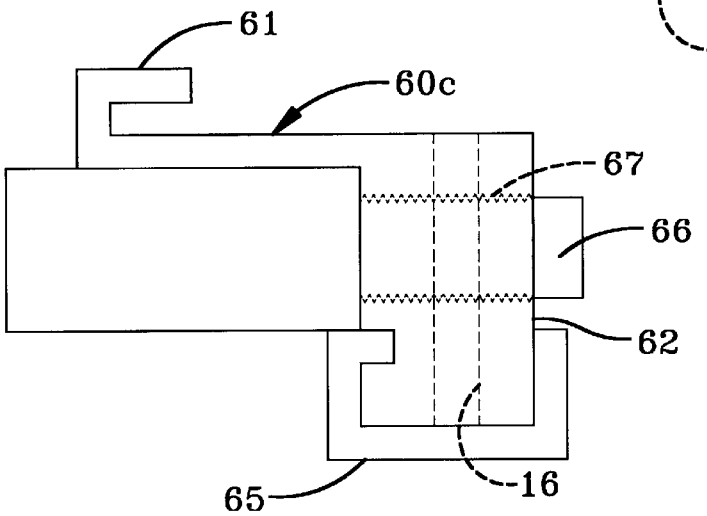
FIG. 22 is a side view of a modified connector joined with a cap-sleeve along a tongue and groove joint.

Another embodiment comprises connectors 60*a,* 60*b,* and 60*c* as seen in FIGS. 20, 21, and 22. As can be seen, these connectors are shaped somewhat like border strips and function in an identical manner to engage the edges of a frame. These connectors, however, function as links from a frame to border strips adhered to edges of a screen. With the addition of the connectors 60*a,* 60*b,* and 60*c,* very small border strips can link up to very large frames. The cupping flange 5 of FIG. 3, cupping flange 6 of FIG. 4, or the cap-sleeve 50 of FIG. 16 is hooked over edge 61 of FIGS. 20, 21, and 22. This is just like hooking over the edges 13*a,* 13*b,* 13*c,* or 13*d* of a frame 3 as in FIG. 2.

FIG. 20 shows a connector 60*a* with a relatively wide cupping flange 63. FIG. 21 shows a connector 60*b* with a relatively narrow cupping flange 64. FIG. 22 shows a connector 60*c* with a sleeve-cap 65. These cupping features function just as earlier described for border strips. These connectors 60*a,* 60*b,* and 60*c* may optionally have holes 16 which permit them to attach to stretcher devices and/or they may have screws 66 that allow them to be forced outwardly, once mounted on a frame. Screws 66 are positioned on the walls 62 of connectors that parallel the outside edges of the frame and are positioned perpendicular to the frame edges so as to abut the frame outside walls when they are screwed inwardly. By turning screws 66, which are on threaded bores 67 as shown in FIGS. 20, 21, and 22, the screws 66 power the connectors 60*a,* 60*b,* and 60*c* outwardly.

The border strips 2*a,* 2*b,* 2*c,* 2*d,* 2*aa,* 2*bb,* 2*cc,* and 2*dd* of the present invention may further comprise screws (not illustrated) to power the outward movement of the border strips from a frame.

Figure 23:
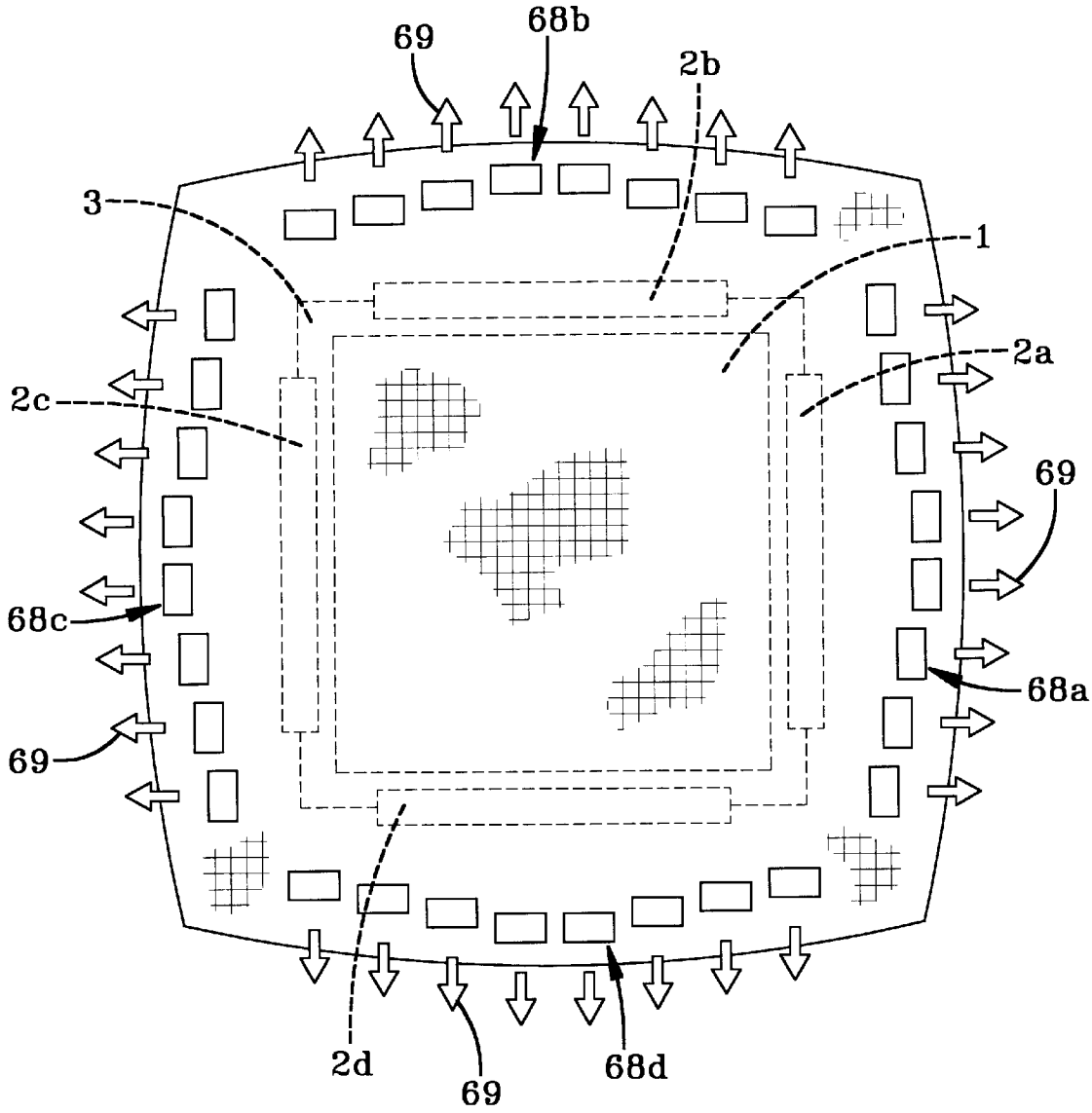
FIG. 23 is top view of a plurality of stretchers on each side of a piece of fabric stretching the fabric over a printing frame with mounted border strips.
Figure 24:
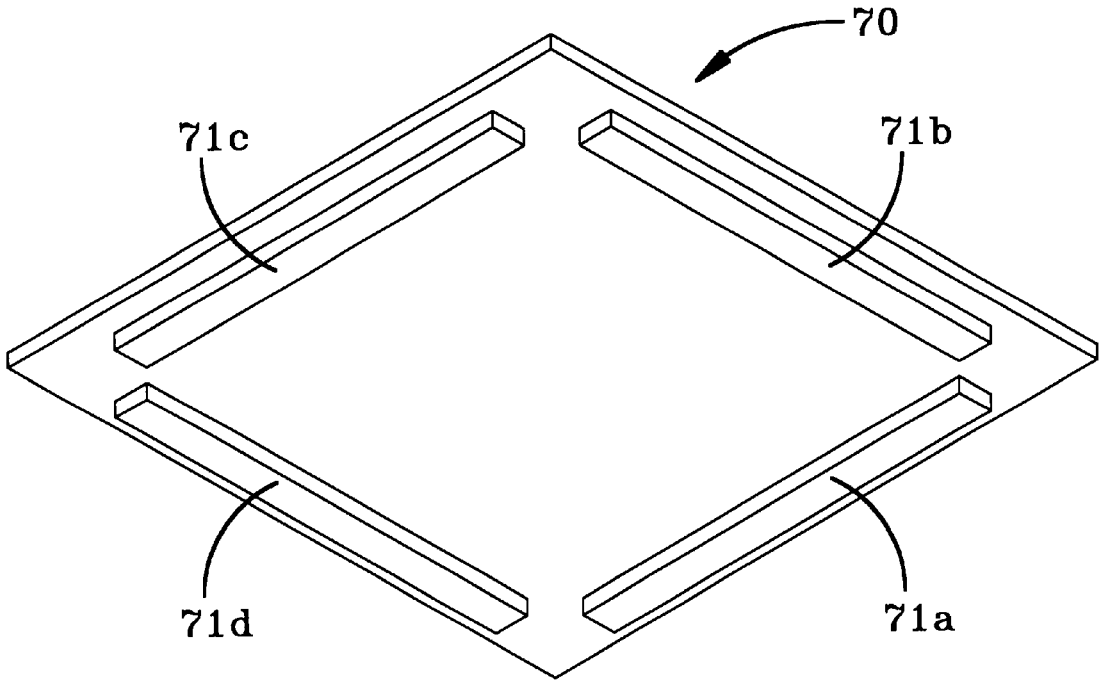
FIG. 24 is a perspective drawing of a platen with heat pads as seen from the bottom.

FIG. 23 shows a fabric piece 1 that is placed over a frame 3 with border strips 2*a,* 2*b,* 2*c,* and 2*d* mounted on the edges of said frame 3. Fabric piece 1 is larger than frame 3 and, in the preferred embodiment, is gripped and stretched with an outward force 69 to a prescribed tension by stretcher devices 68*a,* 68*b,* 68*c,* and 68*d* on each side of frame 3. Border strips 2*a,* 2*b,* 2*c,* and 2*d,* which are in surface contact with the stretched fabric piece are then bonded to the fabric piece. After this is completed, the stretcher devices can reduce the force exerted on the fabric piece. Fabric 1 within the area bounded by border strips 2*a,* 2*b,* 2*c,* and 2*d* on frame 3 remains at high tension whereas fabric 1 outside the area bounded by border strips 2*a,* 2*b,* 2*c,* and 2*d* is now relaxed and may be trimmed away. The screen is now not only bonded to the border strips but it is also mounted on the frame and is ready for use. There is no need for a secondary operation to mount the bordered screen onto a frame as in the earlier art. A plurality of screens may be mounted onto frames from one larger piece of fabric using the above method for further economy.

Figure 25:
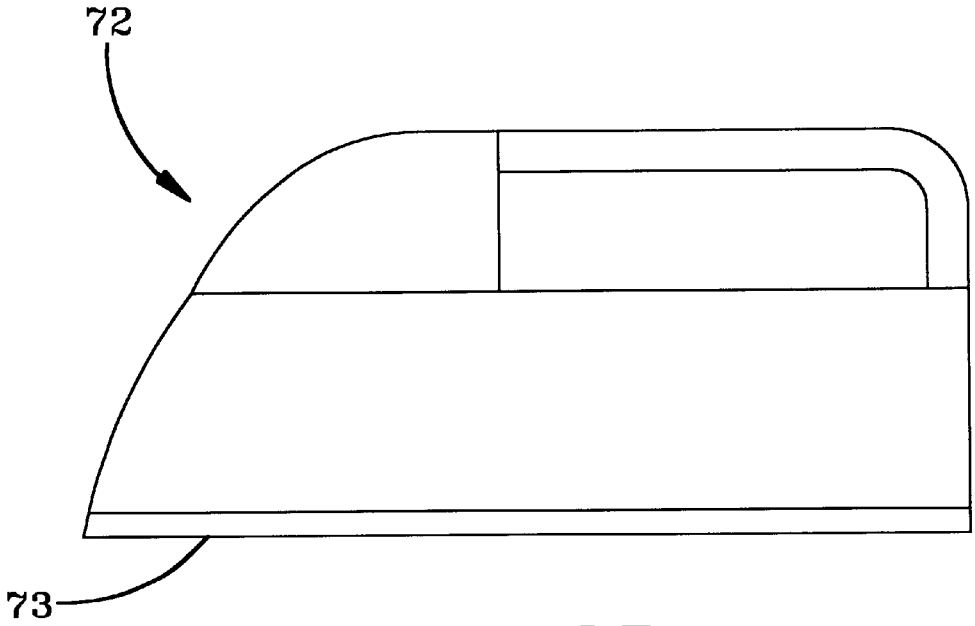
FIG. 25 is a side view of a heating iron.
Figure 26:
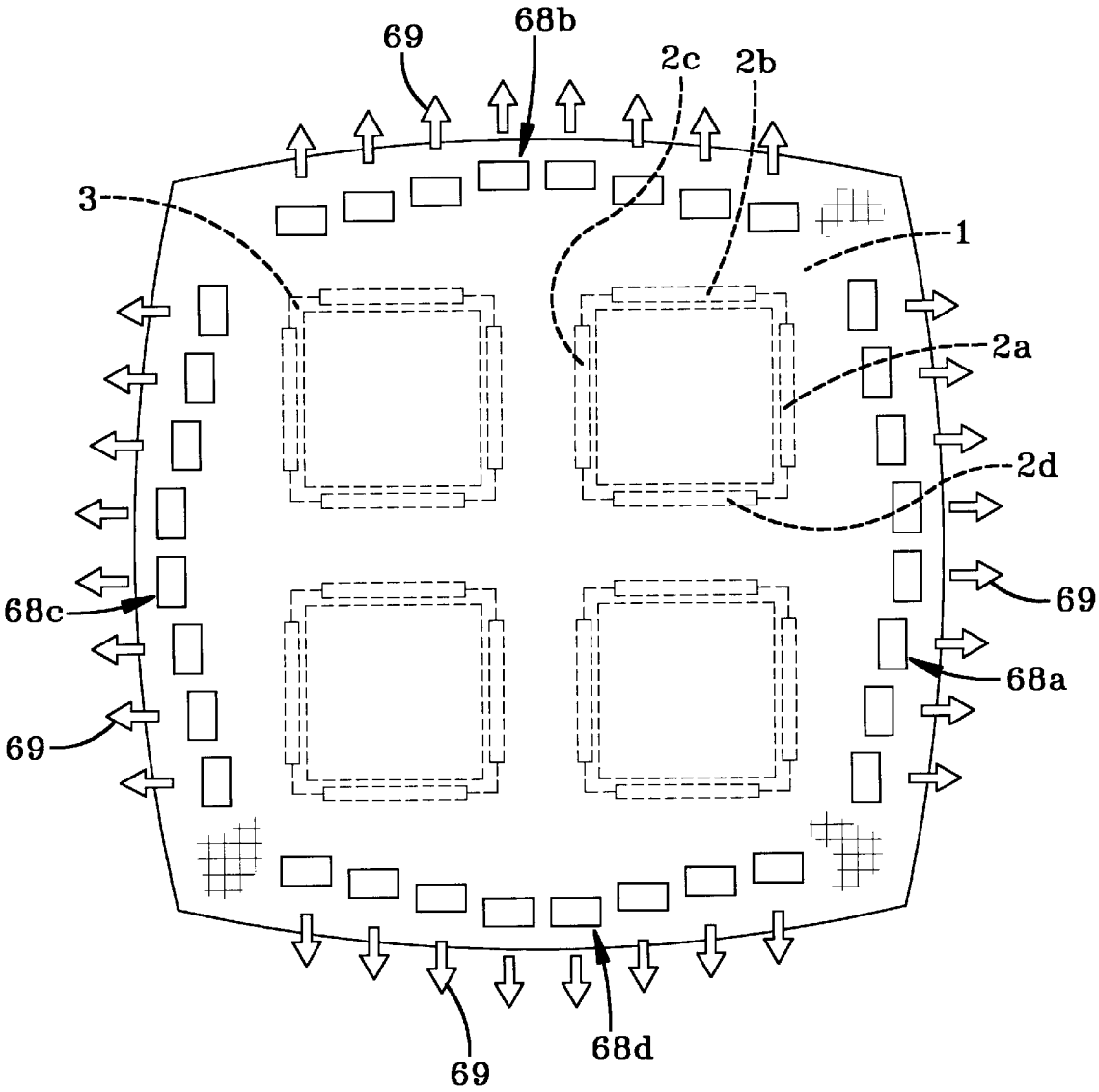
FIG. 26 is a top view of a plurality of stretchers on each side of a piece of fabric stretching the fabric over a plurality of printing frames with mounted border strips.

FIG. 25 shows a descending and ascending platen 70 which has heating pads 71*a,* 71*b,* 71*c,* and 71*d* configured in a pattern so as to align and melt border strips 2*a,* 2*b,* 2*c,* and 2*d.* Platen 70 descends onto screen 1 sandwiching the screen fabric 1 over the border strips. The pressing down of the heat pads forces fabric 1 into the melted polypropylene or other suitable melting materials causing the melted materials to encapsulate the fabric. With the fabric so encapsulated, the cooling and hardening of the polypropylene or other materials forms a very strong mechanical bond with the fabric assuming that steps are taken to prevent the polypropylene from sticking to the heat pads when the platen ascends. The heat pads should be coated with a stick resistant material and/or vellum paper may be used as a barrier between the heat pads and the fabric to prevent sticking. FIG. 25 shows a heating iron 72 suitable for melting polypropylene or other materials onto screen fabric. The iron 72 comprises a flat bottom surface 73 for sandwiching stretched screen fabric 1 onto border strips 2*a,* 2*b,* 2*c,* and 2*d.* Heating iron 72 must be set at an appropriate temperature and is manually pressed downwardly onto fabric 1 and border strips 2*a,* 2*b,* 2*c,* and 2*d* beneath. With screen fabric 1 so sandwiched, border strips 2*a,* 2*b,* 2*c,* and 2*d* are melted into the fabric so as to encapsulate the fabric. It is important that steps are taken to prevent the sticking of the melted polypropylene to the iron. Heat sealing is the preferred bonding process of the present invention, although other processes such as gluing may also be used.

The above described platen and heating iron used in a manner as described above enable border strips made of a suitably meltable material to be melted into a screen of rectangular shape with the border strips on each edge of the screen. The melted material forms a bond of sufficient strength to singularly hold the screen on a frame when the screen is tightly stretched on the frame.

The foregoing descriptions of the preferred embodiments of the invention have been presented for the purpose of illustration and description. It is not intended to be exhaustive or to limit the invention to the precise forms described. Many modifications and variations are possible in light of the above teaching. It is intended that the scope of the invention be limited not by this detailed description, but rather by the claims appended hereto.

What is claimed is:

1. A screen of rectangular shape comprising border strips along each edge of said screen, not in the corners, said border strips comprising cupping flanges adapted to hook over edges of a frame for holding said screen on said frame when said screen is stretched, said cupping flanges opposite to each other on said screen having unequal width.

2. A screen of rectangular shape comprising border strips along each edge of said screen, not in the corners, said border strips comprising cupping flanges adapted to hook over edges of a frame for holding said screen on said frame when said screen is stretched, said border strips comprising internal screws, not part of an external stretcher device, to move said border strips outwardly from said edges of said frame whereby said screen is re-tensioned.

3. A rectangular frame, connectors, and cupping flanges releasably joinable to said connectors, said connectors and said cupping flanges adapted to hook over edges of said rectangular frame, not in the corners, when said connectors and said cupping flanges are joined, said connectors further comprising edges adapted for screen border strips to hook over, said border strips holding a screen on said connectors when said screen is stretched.

4. The rectangular frame, connectors, and cupping flanges of claim 3 whereby each of said releasably joinable cupping flanges comprises a tongue and sleeve adapted to slide off and on said connectors, each of said connectors comprising a groove joint to engage said tongue and walls to engage said sleeve.

5. The rectangular frame, connectors, and cupping flanges of claim 3 comprising internal screws, not part of an external stretcher device, said internal screws adapted to move said connectors and said cupping flanges outwardly from said rectangular frame whereby said screen is re-tensioned.

6. A screen assembly comprising a screen of rectangular shape having border strips along each edge of said screen, not in the corners, cupping flanges releasably joinable to said border strips, and a frame comprising a print side surface and an opposite non-print side surface, said frame comprising outside edges, said border strips comprising a base section adapted to abut against said outside edges of said frame, said border strips further comprising a print side flange adapted to overlap said print side surface of said frame, said print side flange attached to said screen, said cupping flanges adapted to releasably join said border strips and overlap said opposite non-print side surface of said frame.

7. The screen assembly of claim 6 whereby each of said joinable cupping flanges comprises a tongue and sleeve adapted to slide off and on said border strips, each of said border strips comprising a groove joint to engage said tongue and walls to engage said sleeve.

8. A rectangular frame and connectors comprising cupping flanges adapted to hook over each side of said rectangular frame, not in the corners, said cupping flanges that hook over opposite sides of said rectangular frame having unequal widths, said connectors comprising edges adapted for screen border strips to hook over, said border strips holding a screen on said connectors when said screen is stretched.

9. A rectangular frame and connectors comprising cupping flanges adapted to hook over each side of said rectangular frame, not in the corners, said connectors comprising edges adapted for screen border strips to hook over, said border strips holding a screen on said connectors when said screen is stretched, said connectors further comprising internal screws, not part of an external stretcher device, said internal screws adapted to move said connectors outwardly from said rectangular frame whereby said screen is re-tensioned.

10. A frame of a prescribed thickness and stretched screen of rectangular shape comprising border strips melted into and along each edge of said screen, not in the corners, said border strips each comprising a pocket of substantially the same height as the thickness of said frame such that said frame is received within said pocket, said border strips adapted to hook over not more than one edge on each side of said frame whereby said screen is mounted on said frame.

11. An improved method of attaching border strips comprising hooking features onto a fabric piece wherein said fabric piece is stretched by a stretcher device, not part of an oversized frame, comprising clamps and whereby said border strips, composed of a meltable material, are hooked over not more than one edge on each side of at least one frame and are mounted on the sides of said at least one frame, said method comprising the steps of;

a) hooking said border strips over not more than one edge on each side of said at least one frame so as to mount said border strips on said at least one frame, b) placing said fabric piece over said at least one frame, c) gripping said fabric piece with said clamps of said stretcher device, d) stretching said fabric piece over said at least one frame and mounted border strips so that said fabric piece is in contact with said border strips, e) applying heat where said fabric piece is in contact with said mounted border strips on said at least one frame, said heat melting said border strips to said fabric so as to produce a bond between said border strips and said fabric after said heat is withdrawn, f) reducing the force exerted by said stretcher devices, and g) trimming away excess fabric beyond the sides of said at least one frame.

12. The method of claim 11 wherein the at least one frame comprises a plurality of frames.

13. The method of claim 11 comprising said at least one frame, said border strips, and connectors having edges, wherein said connectors are hooked over the sides of said at least one frame and said border strips are hooked over said edges of said connectors.

* * * * *